US006394324B1

(12) United States Patent
Chen

(10) Patent No.: US 6,394,324 B1
(45) Date of Patent: May 28, 2002

(54) DISPENSING DEVICE FOR MOIST TOWEL

(76) Inventor: Mei-Shing Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/849,359

(22) Filed: May 7, 2001

(51) Int. Cl.[7] ..... B65H 1/00
(52) U.S. Cl. ..... 222/561; 222/80; 221/46; 221/303
(58) Field of Search ..... 222/559, 561, 222/80, 46, 303, 306

(56) References Cited

U.S. PATENT DOCUMENTS 6,213,424 B1 * 4/2001 Helfer-Gand ..... 222/192

* cited by examiner

*Primary Examiner*—J. Casimer Jacyna
(74) *Attorney, Agent, or Firm*—A & J

(57) ABSTRACT

The present invention relates to a dispensing device for moist towel, comprising a top cover, a push button, top board, an external cylindrical body, a blocking board, a bottom board, and a bottom cover, wherein the top cover and the bottom cover are respectively mounted at the top and the bottom of the external cylindrical body and are fastened at the cylindrical body by engaging holes at the sides of the cylindrical body, the top cover and one lateral side of the cylindrical body are provided with a sliding slot having mounted with the top board and the bottom board and the end section of the top board is provided with a triangular block and the end section of the bottom board is provided with an upward connection board having an engaging hole, and the top of the connection board is provided with an inter-linked push button, the top cover, and the center of the external cylindrical body are provided with a key hole for cutting and holding moist towel with the top and bottom board.

1 Claim, 6 Drawing Sheets

DISPENSING DEVICE FOR MOIST TOWEL

BACKGROUND OF THE INVENTION

1. Field of the Invention

The present invention relates to structure of a dispensing device, and in particular, a dispensing device for moist towel to dispense moist towel as a single sheet without jamming the dispensing hole.

2. Description of the Prior Art

Conventional structure of moist towel dispenser has the following drawbacks:

(1) The moist towel cannot be withdrawn as a single sheet but as a stacked of moist towels, and in some cases, the dispensing hole is jammed by the moist towel.

(2) The moist towel may be dropped. This is because the moist towel cannot be retained at the dispensing device after withdrawal.

(3) The moist towels are stuck at the dispensing hole and cannot be pulled up. If a force is applied, the moist towel may be torn off.

(4) The rotating button may cause a jam to the moist towel and this will not allow the moist towels to smoothly move to the slot for dispensing.

In view of the above drawbacks, it is an object of the present invention to provide a dispensing device for moist towel so that the above drawback can be mitigated.

SUMMARY OF THE INVENTION

This invention is related to a dispensing device for moist towel.

It is the primary object of the present invention to provide a dispensing device for moist towel, wherein moist towel can be withdrawn as single sheet from a container containing a roll of moist towels without jamming the dispensing hole or tearing the towels or dropping off of moist towels.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
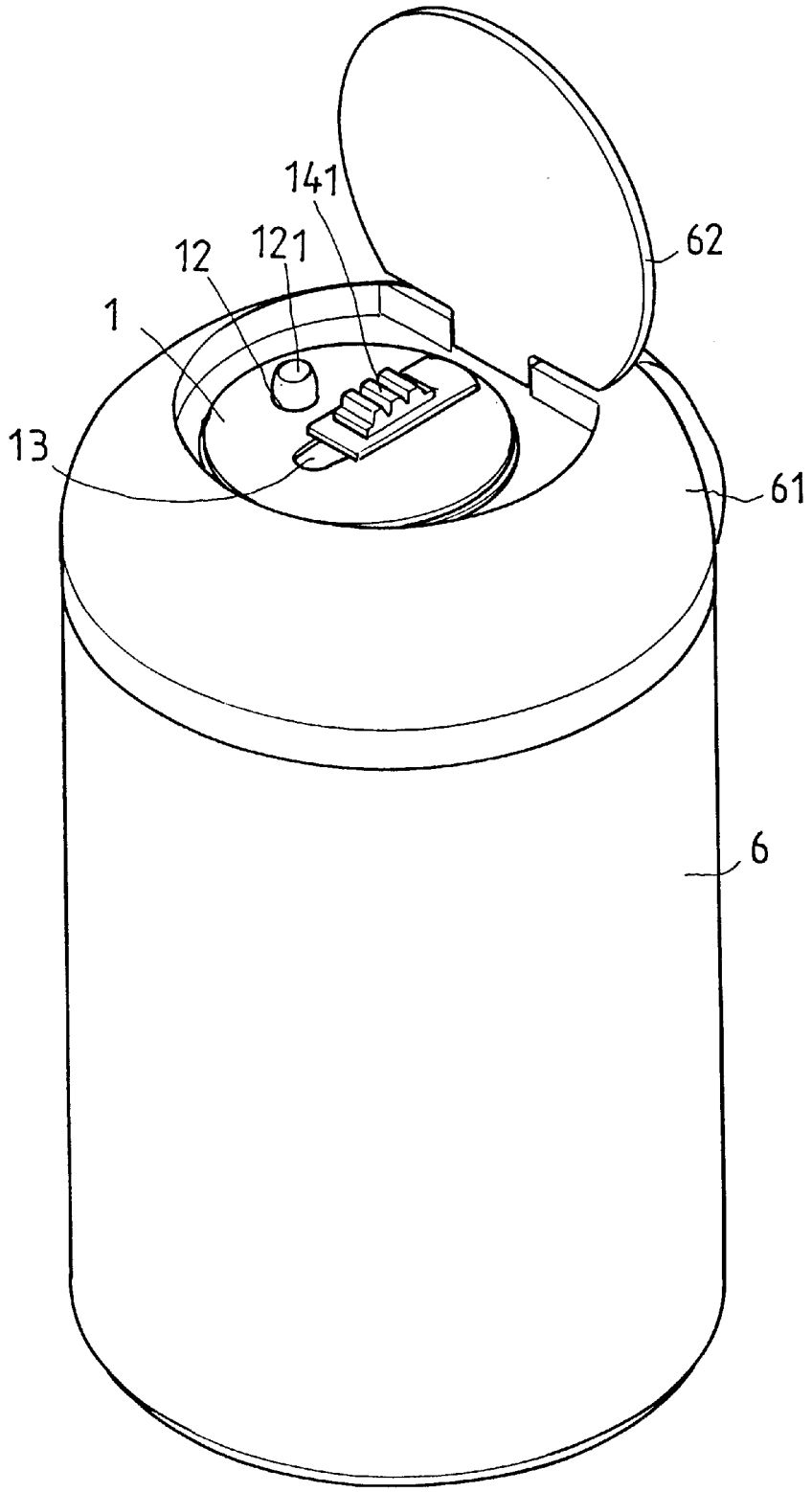
FIG. 1 is a perspective view of the dispensing device containing a container of moist towels.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
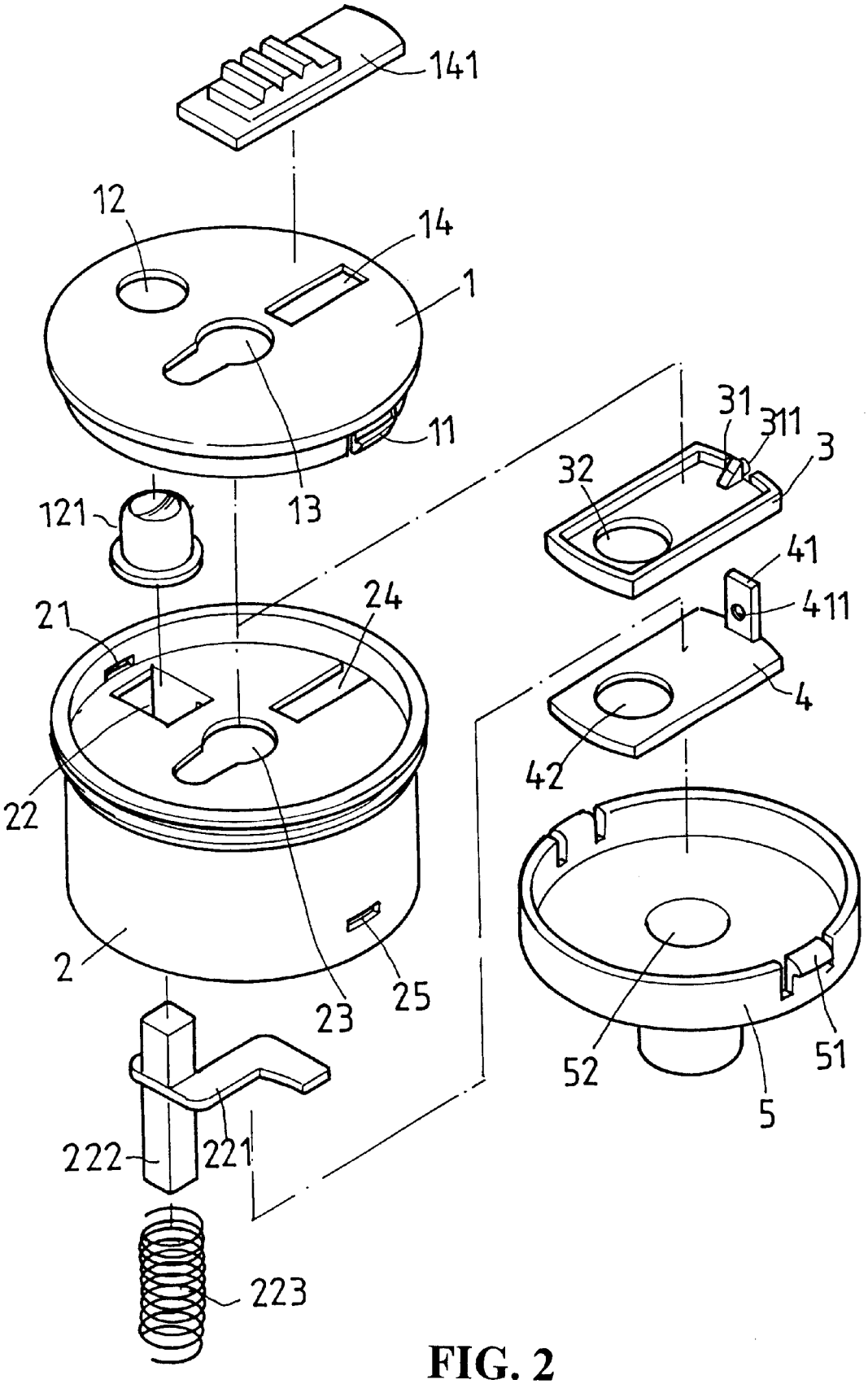
FIG. 2 is a perspective exploded view of the present invention.
Figure 3:
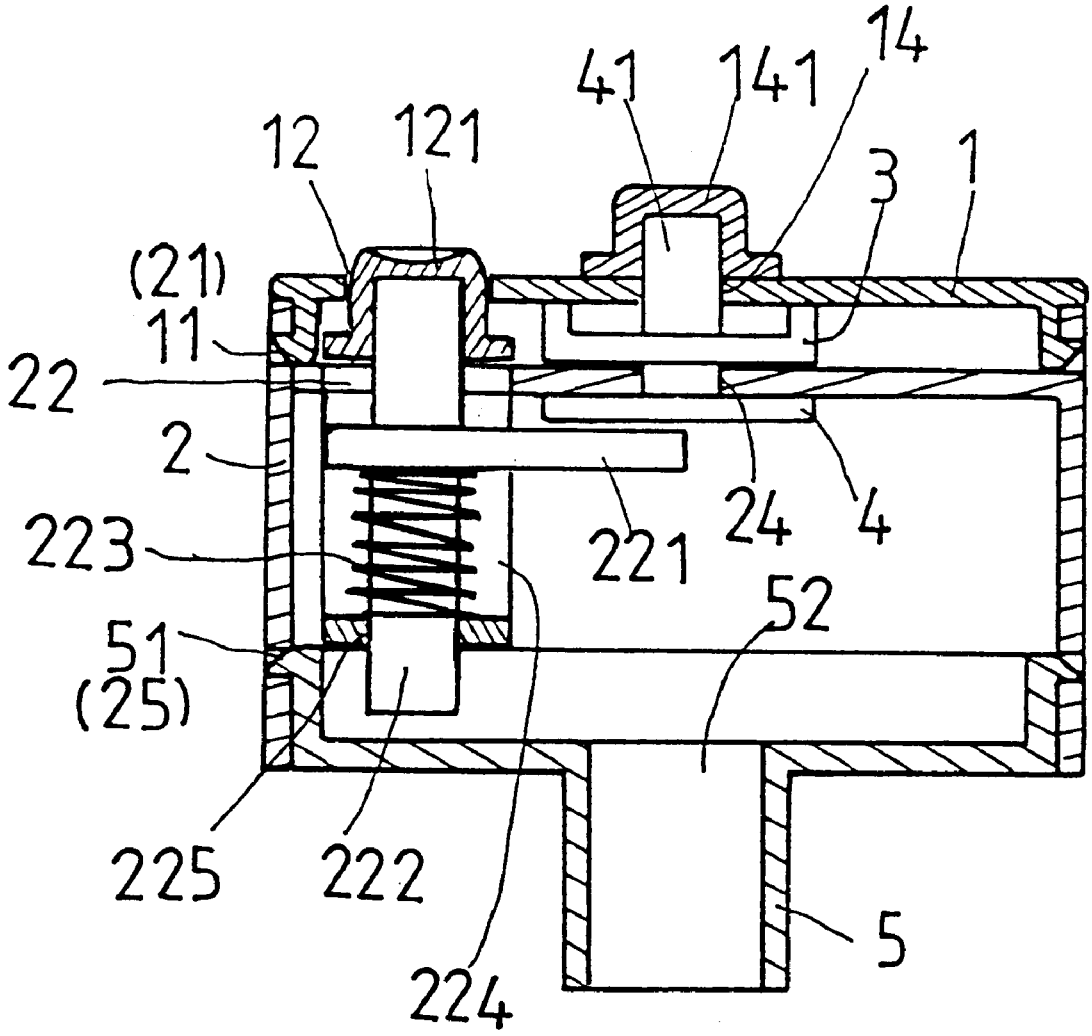
FIG. 3 is the sectional view (the press button is pressed) of the present invention.
Figure 4:
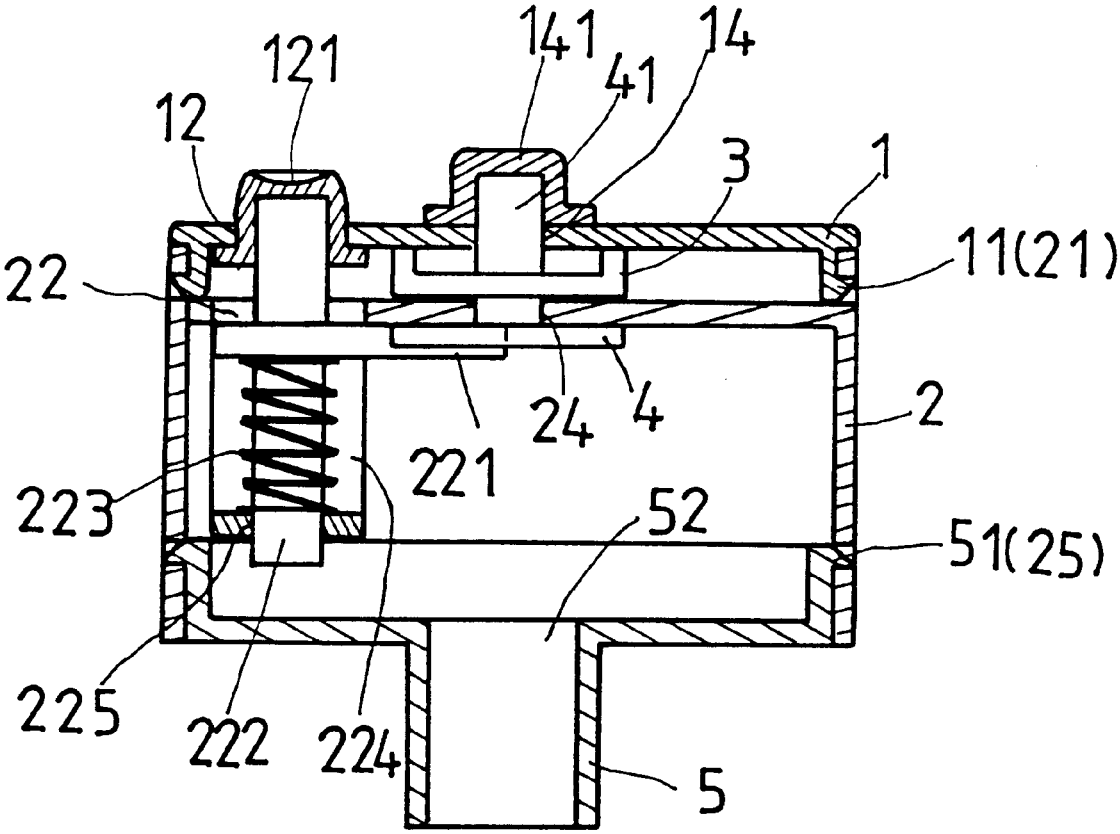
FIG. 4 is the sectional view (before the press button is pressed).
Figure 5:
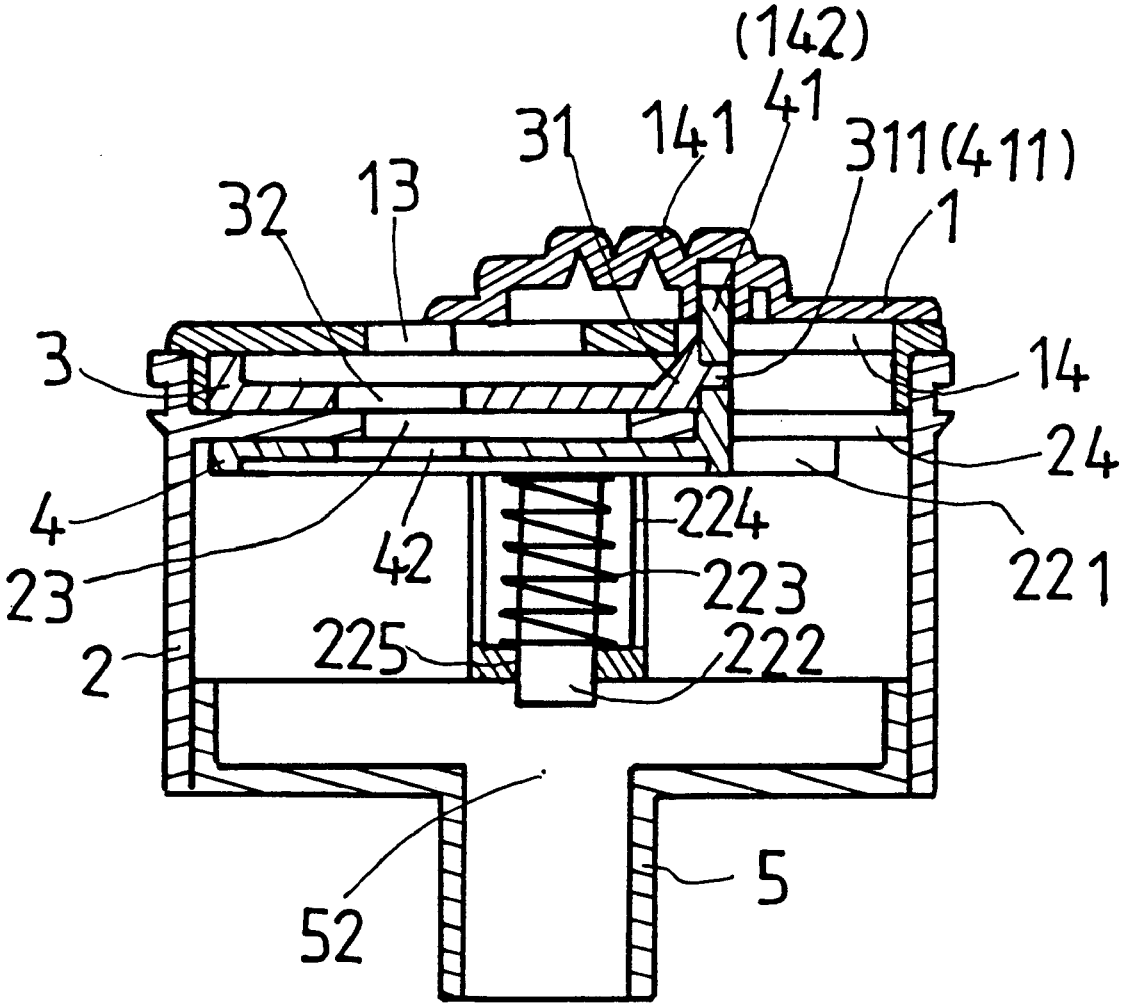
FIG. 5 is a sectional view showing the combination of the push button at position in accordance with the present invention.

Referring to FIGS. 1, 2 and 3, there is shown a dispensing device comprising a top cover 1, a push button 141, a top board 3, an external cylindrical body 2, a blocking board 221, a bottom board 4, a bottom cover 5. The device can accommodate a container 6, containing moist towels, having a top portion 61 with a small cap 62. The top cover 1 and the bottom cover 5 are fastened to form a unit by means of engaging holes 21, 25 at the external cylindrical body 2 and fastening hooks 11, 51 at the sides of the top cover 1 and the bottom cover 5. The top cover 1 and one side of the external cylindrical body 2 are provided with a corresponding long sliding slots 14, 24. The sliding slots 14, 24 are respectively mounted with the top board 3 and bottom board 4. In order to cause the top and bottom boards 3, 4 to simultaneously move together, a triangular block 31 is provided at the end portion of the top board 3 having a circular hole 32, and the external side has a protrusion 311. The end portion of the bottom board 4 is perpendicularly mounted with an inter-linked board 41 having an engaging hole 41 for mounting with the protrusion 311. The top section of the inter-linked board 41 passes through the long sliding slot 14 corresponding to the top cover 1 and engages with the push button 141 as one unit. When the push button 141 is pushed, the top and bottom boards 3, 4 move simultaneously. Besides, the top cover 1, the center of the external cylindrical body 2 provides key holes 13, 23 for the formation of a sharp hole and a circular hole together with circular through holes 32, 43. The other side of the external cylindrical body 2 is provided with a through hole 22 having a fixing seat 224 with a through hole 225. The fixing seat 224 provides the mounting of the blocking board 221, i.e, the lower section of the protrusion 222 is mounted with a spring 223 and the lower section of the protrusion 222 is inserted into the through hole 225 of the fixing seat 224, and the top section of the protrusion 222 passes through the section of the external cylindrical body 2.

At the same time, a press button 121 is located at the top of the protrusion 222. The press button 121 passes through the through hole 12 corresponding to the top cover 1. That is, the press button 121 will protrude above the top section of the top cover 1 for the pressing of the user. The center section of the bottom cover 5 allows the container 6 to pass through.

Figure 6:
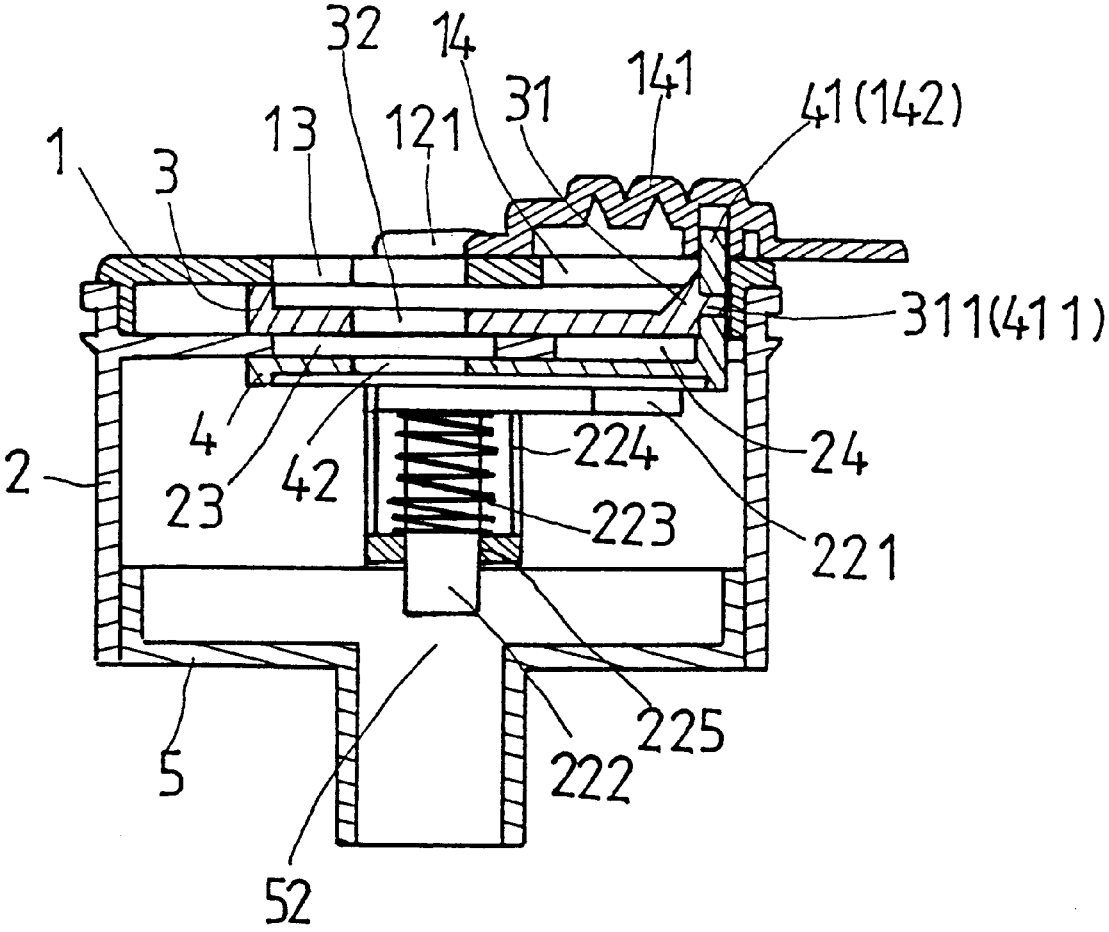
FIG. 6 is a sectional view showing the combination of the push button being pushed to the rear end in accordance with the present invention.

Referring to FIGS. 3 to 6, the press button 121 is first pressed down, the protrusion 222 and the blocking board 221 will move downward. The downward movement will cause the separation of the blocking board 221 and the bottom board 4 (as shown in FIG. 3). When the push button 141 is pushed backward to move the top and the bottom boards 3, 4, the blocking board 221 will adhere to the lower section of the bottom board 4 (as shown in FIG. 6). When the push button 141 is at the rear end of the top cover 1, due to the fact that the top and bottom boards 3, 4 are inter-linked, the front through holes 32, 42 of the top and bottom boards 3, 4 will reach the rear circular hole of the center key hole 13, 23 of the external cylindrical body and the top cover 1. The circular through holes 32, 42 of the top and bottom boards 3,4 will align with the rear circular hole of the central key holes 13, 23. The blocking board 221 is close to the bottom section of the bottom board 4 the spring 223 will be compressed. At this instance, a hook is used to pull up the moist towel through the circular hole 52 to the top cover 1, and the push button 141 is pushed forward, referring to FIGS. 4 and 5, at this instance, the push button 141 will drive the circular through hole 32, 42 at the front end of the top and bottom boards 3, 4 to the sharp hole at the front of the central key holes 13, 23 of the external cylindrical body. The diameter of the sharp hole is 4.5 to 5 mm. The top and bottom boards 3, 4 will drive the moist towel to the sharp hole and cut. As the end section of the N-shaped 221 is adhered at the bottom section of the bottom board 4, when then bottom board 4 is moved forward, the blocking board 221 will be urged to the end section of the bottom board 4 (referring to FIG. 5). At this instance, as a result of the spring 223, the push button 121 is restored upward to urge at the lower section of the through hole 12 of the top cover 1 (referring to FIG. 4). The objective of this is to prevent the backward movement of the top and bottom boards 3, 4, avoiding the cutting of the moist towel. When the moist towel is withdrawn, the circular through hole 32 and the front sharp hole of the central key hole 13 provide the cutting of the moist towel which has been provided with a scored mark. The front end circular through hole 42 of the bottom board 4 and the sharp hole at the center key hole of the external cylindrical body 2. After a moist towel is withdrawn, and avoid the cut moist towel from falling off.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A dispensing device for moist towel comprising a top cover, a push button, a top board, an external cylindrical body, a blocking board, a bottom board and a bottom cover, characterized in that the top cover and the bottom cover are respectively mounted at the top and the bottom of the external cylindrical body and are fastened at the cylindrical body by engaging holes at the sides of the cylindrical body, the top cover and one lateral side of the cylindrical body are provided with a sliding slot having mounted with the top board and the bottom board and the end section of the top board is provided with a triangular block and the end section of the bottom board is provided with an upward connection board having an engaging hole, and the top of the connection board is provided with an inter-linked push button, the top cover, and the center of the external cylindrical body are provided with a key hole for cutting and holding moist towel with the top and bottom board and the through hole at the front end thereof, one lateral side of the external cylindrical body is provided with a fixing seat with a through hole and the blocking board having a protrusion is mounted at the interior of the external cylindrical body to prevent backward movement of the bottom board, and the bottom of protrusion is provided with a spring which is inserted into the through hole, a press button is provided at the top of the protrusion and the bottom of the press button has an engaging recess for the engagement with the protrusion, the center of the bottom cover is provided with a through hole allowing the moist towel to be inserted, thereby, by means of the top board and the bottom board together with the action of the through hole at the front end thereof being pushed to a sharp hole at the front of the key hole, the top cover and the top board together with the external cylindrical body with the bottom board cut the moist towel and hold the moist towel, wherein the through hole at the front end of the top and bottom board, and the locking board has an "N"-shape structure so that the end section thereof urges the end section of the bottom board.

* * * * *